US008991801B2

(12) United States Patent
Plaszewski et al.

(10) Patent No.: US 8,991,801 B2
(45) Date of Patent: Mar. 31, 2015

(54) CLAMPING DEVICE

(76) Inventors: Rey Plaszewski, St. Charles, IL (US); Roman Plaszewski, Elburn, IL (US)

( * ) Notice: Subject to any disclaimer, the term of this patent is extended or adjusted under 35 U.S.C. 154(b) by 272 days.

(21) Appl. No.: 13/613,123

(22) Filed: Sep. 13, 2012

(65) Prior Publication Data

US 2014/0070472 A1 Mar. 13, 2014

(51) Int. Cl.

| | |
|---|---|
| ***B25B 11/00*** | (2006.01) |
| ***H01F 7/20*** | (2006.01) |
| ***A47G 1/17*** | (2006.01) |
| ***H01F 7/02*** | (2006.01) |

(52) U.S. Cl.

CPC ..... *B25B 11/002* (2013.01); *H01F 7/0252* (2013.01)

USPC ..... 269/8; 335/289; 248/206.5

(58) Field of Classification Search

CPC ..... B25B 11/002

USPC ..... 269/8; 335/289, 385; 248/506.5

See application file for complete search history.

(56) References Cited

U.S. PATENT DOCUMENTS

| | | | | |
|---|---|---|---|---|
| 4,616,796 | A * | 10/1986 | Inoue | 248/206.5 |
| 5,828,224 | A * | 10/1998 | Maruyama | 324/756.02 |
| 6,812,817 | B2 * | 11/2004 | Thibideau | 335/285 |
| 7,940,149 | B2 * | 5/2011 | Lee | 335/289 |
| 2007/0131829 | A1 * | 6/2007 | Thompson | 248/206.5 |
| 2009/0001641 | A1 * | 1/2009 | Wu et al. | 269/8 |
| 2011/0049087 | A1 * | 3/2011 | Ferguson | 216/13 |
| 2011/0095464 | A1 * | 4/2011 | Wu et al. | 269/8 |

FOREIGN PATENT DOCUMENTS

WO WO 2010125592 A1 * 11/2010 ..... B25B 11/00

* cited by examiner

*Primary Examiner* — Lee D Wilson
*Assistant Examiner* — Alvin Grant
(74) *Attorney, Agent, or Firm* — Law Offices of Eugene M. Cummings, P.C.

(57) ABSTRACT

A clamping device for magnetically clamping non-magnetic material objects. The clamping device comprises first and second clamp members each having at least one straight edge surface and each having at least one magnet disposed therein. The first and second clamp members are adapted to magnetically and removably couple to each other, wherein the magnetic coupling is capable of clamping at least one non-magnetic material object. The clamping device is further at least partially transparent, includes markings to facilitate correct alignment of the clamp members and comprises a support member for securely positioning the clamping device on an underlying surface.

20 Claims, 3 Drawing Sheets

CLAMPING DEVICE

CROSS-REFERENCE TO RELATED APPLICATIONS

None.

TECHNICAL FIELD

This application relates to tools and devices that aid in the assembly of certain material structures and in particular to a clamping device for magnetically clamping non-magnetic material objects. One particular possible use of the disclosed clamping device is as a model building tool to facilitate the assembly of model train structures (e.g., scale buildings) or the like by temporarily holding in place model pieces during model assembly.

BACKGROUND OF THE DISCLOSURE

Subject of this disclosure are certain improvements over a prior clamping device. In particular, the prior clamping device comprises two clamp members, i.e., an inner and an outer clamp member. Each of the clamp members is made of an opaque material and each further comprises two magnets. The outer clamp member is L-shaped and comprises two interior straight edge surfaces whose respective longitudinal axes are perpendicular to each other. The inner clamp member comprises two exterior straight edge surfaces. The two clamp members are adapted to magnetically and removably couple to each other, wherein the magnetic coupling is capable of clamping at least one non-magnetic material object.

The prior clamping device is primarily used by model builders to assemble model structures, such as for example, architectural models, scale buildings for use in model train displays and dioramas, doll houses, art projects, etc. In particular, the prior clamping device is used to temporarily hold in place pieces of the model structure in order to permanently affix the model pieces to each other. How the pieces are permanently affixed to each other will depend on the particular type of material. Common model materials are plastic, wood, cardboard, etc. which would commonly be affixed to each other by the appropriate type of adhesive (liquid or semi-liquid). The prior clamping device attempts to free the modeler's hands from having to hold the model pieces during assembly by magnetically holding the model pieces in place, facilitating alignment of the model pieces and the application of the adhesive to the model pieces.

However, the prior clamping device has a number of shortcomings and disadvantages that limit its practicality and usefulness. Selected exemplary shortcomings of the prior clamping device are set forth below.

Because of the narrow design of the prior art clamping device (i.e., the outer clamping member) it does not securely support itself in an upright position when placed on a work surface but will tip on its side unless held in place by the modeler. This is particularly undesirable when model pieces to be assembled are positioned on the clamping device. To illustrate, a modeler using the prior clamping device will typically perform the following steps: (1) while supporting the outer clamp member with one hand, with the other hand placing the model pieces on the outer clamp member, (2) while supporting the outer clamp member (and the model pieces) with one hand, with the other hand lining up the inner clamp member with the outer clamp member to magnetically couple the clamp members with the model pieces in between them, (3) while supporting the clamping device with one hand, with the other hand aligning the model pieces to ensure proper assembly, and (4) while supporting the clamping device with one hand, with the other hand applying the adhesive to the appropriate areas of the model pieces. Finally, while the adhesive works to bond the model pieces together the modeler must either: (1) tolerate that the clamping device and the model pieces tip to one side during the bonding of the adhesive, (2) hold the clamping device with the model pieces until the bonding process has sufficiently advanced to prevent the model pieces from shifting relative to each other, or (3) use at least a second prior clamping device to hold the model pieces together, whereby the second clamping device prevents the setup from tipping on its side.

Furthermore, the outer and inner clamp members of the prior clamping device are made of an opaque material, which limits the modeler's view of the model pieces clamped in the device during assembly. In addition, the inner clamp member of the prior clamping device has no openings that would allow a modeler to insert, for example, an applicator for adhesives.

Another substantial shortcoming of the prior clamping device is its lack of any visual or tactile markings indicating the correct alignment of the outer and the inner clamp members with regard to the respective polarity of the magnets disposed therein, an issue necessitated by the basic principle that unlike magnetic poles attract, while like magnetic poles repel each other. This is a problem because the modeler must rely on trial and error to correctly align the clamping members so that the bringing together of unlike magnetic poles result in an attraction, i.e., coupling of the two clamp members. An incorrect alignment of the clamp members, i.e., bringing together like magnetic poles, would result in their repelling each other. The repelling forces may cause unwanted shifting of the clamping device itself and/or any material pieces located on it.

Thus, there exists a need for an improved clamping device to remedy at least the shortcomings described above. In particular, it would be desirable to have a clamping device that has a support member allowing the tool to support itself and to more securely position the clamping device on a work surface.

It would also be desirable for the clamping device to provide at least one opening in at least one of the clamp members so as to allow a user to insert an elongated glue applicator if desired.

It would further be desirable for at least a part of at least one clamp member to be made of a transparent instead of an opaque material, so as to provide the user with better visibility of the area being worked on.

Furthermore, it would be desirable for the clamping device to comprise visual and/or tactile markings indicating to the user the correct alignment of the clamp members with regard to the respective polarity of the magnets disposed therein so as to facilitate that unlike poles of the respective magnets are aligned to each other in a way that causes the clamp members to magnetically couple to each other based on the magnetic attraction of the respective magnets.

The following description is presented to enable one of ordinary skill in the art to make and use the disclosure and is provided in the context of a patent application and its requirements. Various modifications to the preferred embodiment and the generic principles and features described herein will be readily apparent to those skilled in the art. Thus, the present disclosure is not intended to be limited to the embodiments shown, but is to be accorded the widest scope consistent with the principles and features described herein.

SUMMARY OF THE DISCLOSURE

According to one embodiment of the present disclosure, there is provided a clamping device for magnetically clamping non-magnetic material objects which comprises a first clamp member having at least a first straight edge surface, the first clamp member having at least a first magnet disposed therein; a second clamp member having at least a second straight edge surface, the second clamp member having at least a second magnet disposed therein; wherein the first straight edge surface of the first clamp member and the second straight edge surface of the second clamp member are adapted to magnetically and removably couple the first and second clamp members, wherein the magnetic coupling is capable of clamping a non-magnetic material object in between the first and second straight edge surfaces; and a support member for securely positioning the clamping device on an underlying substantially level surface.

According to another embodiment of the present disclosure, there is provided a clamping device for magnetically clamping non-magnetic material objects which comprises a first clamp member having at least a first straight edge surface, the first clamp member having at least a first magnet disposed therein; a second clamp member having at least a second straight edge surface, the second clamp member having at least a second magnet disposed therein; wherein the first straight edge surface of the first clamp member and the second straight edge surface of the second clamp member are adapted to magnetically and removably couple the first and second clamp members, wherein the magnetic coupling is capable of clamping a non-magnetic material object in between the first and second straight edge surfaces; wherein at least one of the clamp members is at least partially transparent proximate to the respective straight edge surface; and a support member for securely positioning the clamping device on an underlying substantially level surface.

According to yet another embodiment of the present disclosure, there is provided a clamping device for magnetically clamping non-magnetic material objects which comprises a first clamp member having at least a first straight edge surface, the first clamp member having at least a first magnet disposed therein; a second clamp member having at least a second straight edge surface, the second clamp member having at least a second magnet disposed therein; wherein the first straight edge surface of the first clamp member and the second straight edge surface of the second clamp member are adapted to magnetically and removably couple the first and second clamp members, wherein the magnetic coupling is capable of clamping a non-magnetic material object in between the first and second straight edge surfaces; and wherein the first and second clamp members each comprise a marking indicating the correct alignment of the first and second clamp members with respect to each other so as to ensure that the poles of the respective magnets disposed in the clamp members are aligned in a way that they attract each other, resulting in a magnetic coupling of the clamping members.

BRIEF DESCRIPTION OF THE DRAWINGS

The present disclosure will be more fully understood by reference to the following detailed description of one or more preferred embodiments when read in conjunction with the accompanying drawings, in which like reference characters refer to like parts throughout the views and in which.

DETAILED DESCRIPTION OF THE ILLUSTRATED EMBODIMENT

Figure 2:
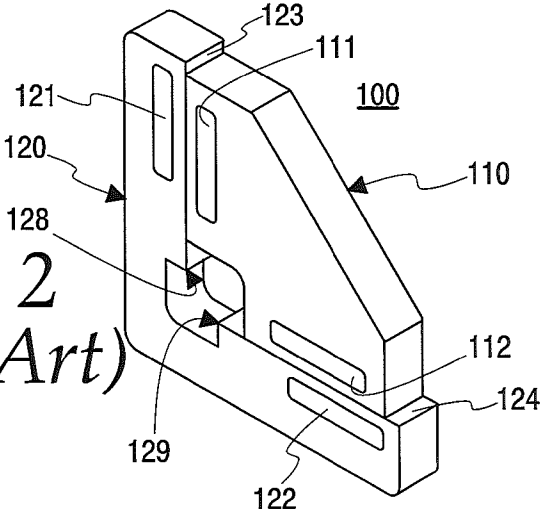
Fig. 2 (Prior Art)
FIG. 2 is a perspective view of the prior art clamping device.
Figure 1:
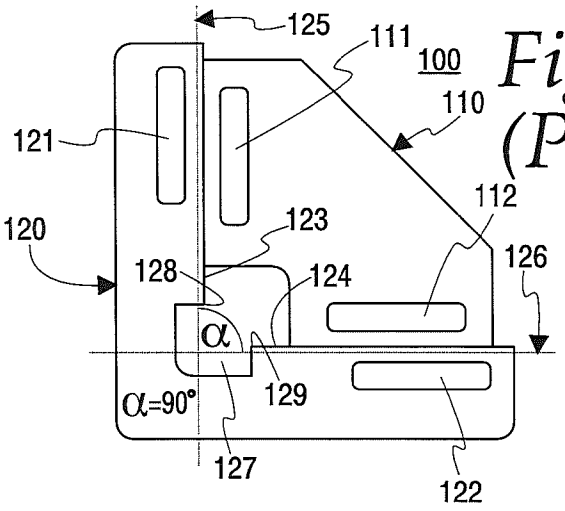
Fig. 1 (Prior Art)
FIG. 1 is a side view of the prior art clamping device.
Figure 3A:
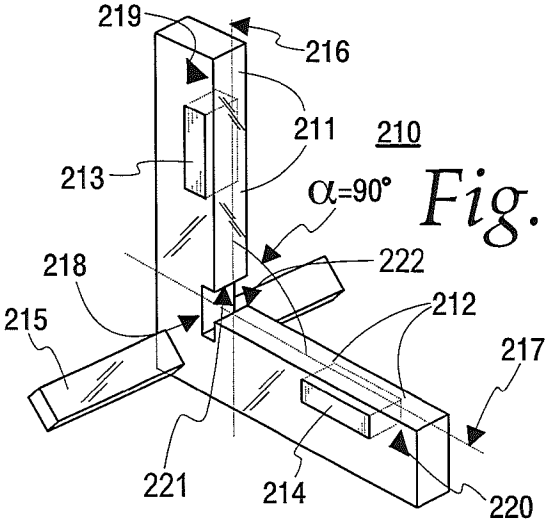

Turning to the Figures and to FIGS. 1 and 2 in particular, the prior art clamping device 100 is shown. In particular, the prior clamping device 100 comprises two clamp members, i.e., an inner clamp member 110 and an outer clamp member 120. Each of the clamp members 110 and 120 is made of an opaque material (i.e., opaque plastic). Inner clamp member 110 also comprises magnets 111 and 112 and outer clamp member 120 comprises magnets 121 and 122. Outer clamp member 120 is L-shaped and comprises two interior straight edge surfaces 123 and 124 along their respective longitudinal axes 125 and 126 which are perpendicular (i.e., 90 degree angle) to each other. Straight edge surface 123 terminates into recess 127 at surface step 128. Straight edge surface 124 terminates into recess 127 at surface step 129. Inner clamp member 110 further comprises two exterior straight edge surfaces (not shown) also along their respective longitudinal axes which are perpendicular to each other. As illustrated in FIGS. 1 and 2, inner and outer clamp members 110 and 120 are adapted to magnetically couple to each other. The functionality and shortcomings of prior art clamping device 100 have been described above.

FIGS. 3-6 show one embodiment of an improved clamping device 200 subject of the present disclosure. In particular, FIG. 3*a* depicts outer clamp member 210 and FIG. 3*b* depicts inner clamp member 230. Outer clamp member 210 is shown to include straight edge surfaces 211 and 212. Straight edge surface 211 terminates into recess 218 at surface step 221. Straight edge surface 212 terminates into recess 218 at surface step 222.

In the embodiment of clamping device 200 shown in FIGS. 3-6, both outer clamp member 210 and inner clamp member 230 are entirely made of a uniformly transparent material (e.g., plastic), but could also at least partially be transparent proximate to straight edge surfaces 211 and 212 so as to provide the user with better visibility of the area being worked on. Outer clamp member 210 further includes magnets 213 and 214. Magnet 213 is disposed within outer clamp member 210 at a location near straight edge surface 211, while magnet 214 is disposed at a location near straight edge surface 212 to facilitate magnetic coupling with inner clamp member 230.

In other embodiments of the present disclosure (not shown), only a single magnet or more than two magnets may be disposed within outer clamp member 210. For example, only a single magnet may be disposed within outer clamp member 210, whereby the single magnet could be positioned within the base of the L-shaped outer clamp member 210. Furthermore, the exact location of the magnet(s) is not a limitation of the present disclosure so long as the desired magnetic coupling of the clamp members is achieved.

Figure 3B:
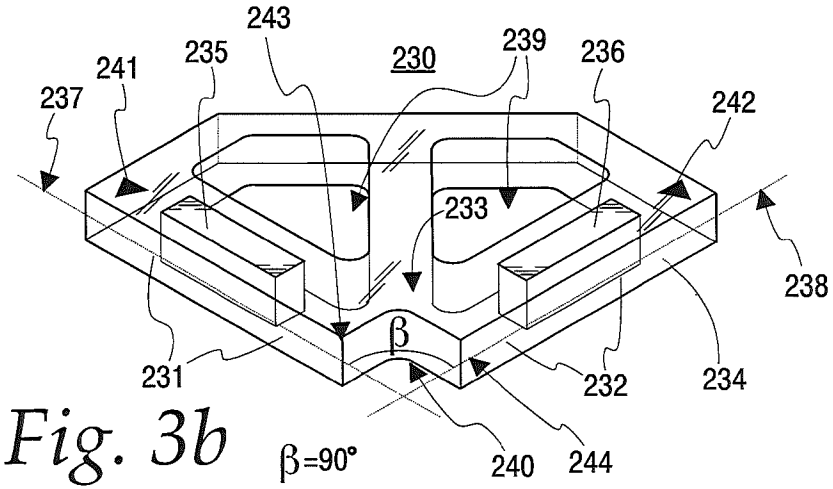
FIGS. 3*a* and 3*b* are perspective views of one embodiment of the present disclosure of an improved clamping device, in particular of the outer clamp member and the inner clamp member.

With particular reference to FIG. 3*b*, inner clamp member 230 is shown to include straight edge surface 231 and straight edge surface 232 as well as lateral surface 233 and lateral surface 234. Straight edge surface 231 terminates into recess 240 at surface step 243. Straight edge surface 232 terminates into recess 240 at surface step 244.

The embodiment of inner clamp member 230 shown in FIGS. 3-6 is entirely made of a uniformly transparent material (e.g., clear plastic) but could also at least partially be transparent proximate to straight edge surfaces 213 and 214 so as to provide the user with better visibility of the area being worked on. Inner clamp member 230 further includes magnets 235 and 236. Magnet 235 is disposed within inner clamp member 230 at a location near straight edge surface 231, while magnet 236 is disposed at a location near straight edge surface 232 to facilitate magnetic coupling with outer clamp member 210 and in particular with the corresponding straight edge surfaces 211 and 212 and the respective magnets 213 and 214 of outer clamp member 210.

Figure 5:
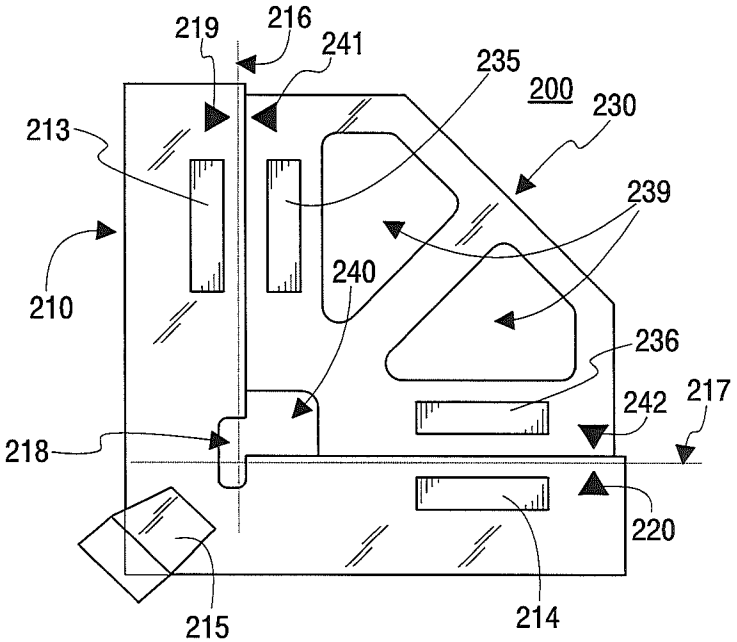
FIG. 5 is a side view of one embodiment of the present disclosure of an improved clamping device showing the device with its outer and inner clamp members magnetically coupled to each other, whereby the device has been rotated clockwise by 90 degrees relative to the view provided in FIG. 4.
Figure 6:
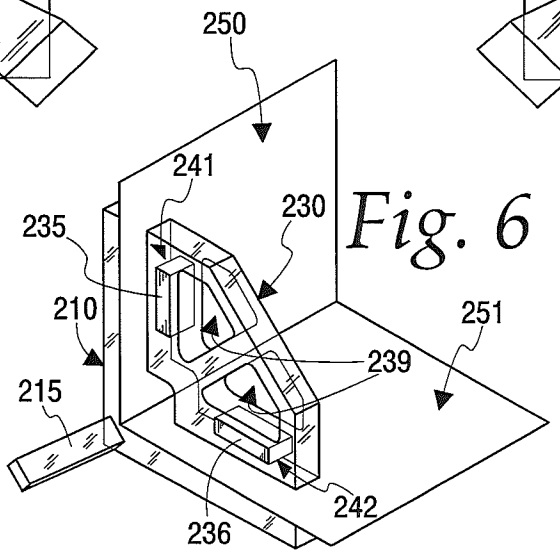
FIG. 6 is a perspective view of one embodiment of the present disclosure of an improved clamping device showing the device with its outer and inner clamp members magnetically coupled to each other thereby clamping material objects between them.
Figure 4:
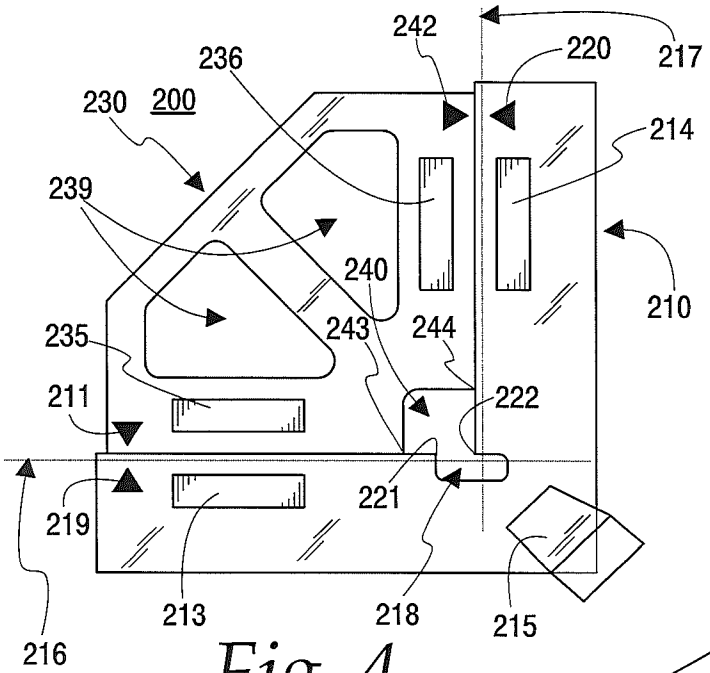
FIG. 4 is a side view of one embodiment of the present disclosure of an improved clamping device showing the device with its outer and inner clamp members magnetically coupled to each other.

When outer clamp member 210 and inner clamp member 230 are magnetically coupled to each other, as best shown in FIGS. 4-5, the coupling is such that it creates flush connections between straight edge surfaces 211 and 231 and straight edge surfaces 212 and 232, respectively. As best shown in FIG. 6, the magnetic coupling of outer clamp member 210 and inner clamp member 230 is capable of clamping non-magnetic material objects 250 and 251 in between clamp members 210 and 230.

As described above, because of the straight edge surfaces 211, 212, 231 and 232, clamping device 200 is particularly adapted to clamp non-magnetic sheet-type material objects, such as for example, plastic or wood wall segments for architectural models, scale buildings for use in model train displays and dioramas, doll houses, art projects, etc. However, it is not required that the straight edge surfaces 211, 212, 231 and 232 are smooth, as long as they are straight relative to their respective longitudinal axes 216, 217, 237 and 238. For example, to provide enhanced grip when clamping material objects with a soft surface, at least a part of at least one of the straight edge surfaces could have a rough, grooved, or otherwise enhanced surface.

Referring again to FIG. 3*a* and further to FIGS. 4 and 5, clamping device 200, and in particular outer clamp member 210, further includes support member 215, which in this embodiment is disposed on the outer clamp member 210 as shown. In particular, support member 215 is positioned on the outer base of L-shaped outer clamp member 210 so as to allow two alternative placements of outer clamp 210 on a work surface. In a first possible placement of outer clamp member 210, as best shown in FIG. 4, straight edge surface 211 and its respective longitudinal axis 216 are aligned parallel to the an underlying work surface, and straight edge surface 212 and its respective longitudinal axis 217 are perpendicular to the underlying work surface. In a second possible placement of outer clamp member 210, as best shown in FIG. 5, straight edge surface 212 and its respective longitudinal axis 217 are aligned parallel to the an underlying work surface, and straight edge surface 211 and its respective longitudinal axis 216 are perpendicular to the underlying work surface.

The presence of a support member 215 increases the footprint of clamping device 200 and in particular of outer clamp member 210 so as to prevent clamping device 200 from tipping over when placed on a substantially level work surface. Support member 215 further allows a modeler to potentially only use a single clamping device to assemble two material objects, as no second clamping device is required to prevent tipping of the device and any material objects clamped therein. Although the embodiment shown in FIGS. 3-6 includes only a single support member 215 disposed on outer clamp member 210, additional support members may be included and at varying locations of outer clamp member 210 and/or inner clamp member 230. Furthermore, support member 215 may be permanently or removably coupled to clamping device 200.

The embodiment of clamping device 200 depicted in FIGS. 3-6, and as described above, comprises outer clamp member 210 having straight edge surfaces 211 and 212, whereby straight edge surface 211 extends along a longitudinal axis 216 and straight edge surface 212 extends along a longitudinal axis 217. In this embodiment, as best shown in FIGS. 4 and 5, the longitudinal axes 216 and 217 are perpendicular to each other (i.e., longitudinal axis 216 and longitudinal axis 217 intersect at a 90 degree angle) resulting in an overall L-shape of outer clamp member 210. Correspondingly, inner clamp member 230, has a straight edge surface 231 extending along longitudinal axis 237 and a straight edge surface 232 extending along longitudinal axis 238, whereby the longitudinal axes 237 and 238 are also perpendicular to each other (i.e., longitudinal axis 237 and longitudinal axis 238 intersect at a 90 degree angle) in order to align with the corresponding straight edge surfaces 211 and 212 of outer clamp member 210.

Additional variations of this embodiment are envisioned (but not shown) wherein the straight edge surfaces of the outer and inner clamp members intersect at different corresponding angles, so as to allow for the assembly of material objects at angles other than 90 degrees. For example, when the outer clamp member comprises straight edge surfaces having longitudinal axes that intersect at an interior angle of 45 degrees, the corresponding inner clamp member would need to comprise straight edge surfaces having longitudinal axes that intersect at an exterior angle of 135 degrees in order to provide for a flush connection when clamped together.

Further referring to FIGS. 3-6, and in particular to FIG. 3*b*, inner clamp member 230, inner clamp member 230 may further comprise at a least one opening 239 extending from lateral surface 233 to opposite lateral surface 234, whereby opening 239 is physically confined on all of its sides (e.g., a cut-out, bore, etc). For example, opening 239 allows a user to insert an elongated glue applicator if desired.

Alternatively, another embodiment of inner clamp member 230 is envisioned that is generally L-shaped, corresponding to the L-shape of outer clamp member 210 as shown in FIGS. 3-6. Such an alternative embodiment may further provide a grip section, enabling a user to more easily grip and manipulate the inner clamp member.

Further referring to FIGS. 3-6, and in particular to inner clamp member 230, inner clamp member 230 may further comprise recess 240 located between surface steps 243 and 244, so as to provide an opening extending from lateral surface 233 to opposite lateral surface 234, whereby recess 240 may be in the form of a cut-away as best shown in FIGS. 4 and 5. Recess 240 eliminates any areas where the clamping device itself or a part of it blocks the view of or access to material objects 250 and 251, thereby allowing for the continuous application of adhesive to the material objects (i.e., the junction of material objects 250 and 251) clamped in clamping device 200 (see FIG. 6).

Referring now to FIGS. 4 and 5, and in particular to outer clamp member 210, outer clamp member 210 comprises a recess 218 located between surface steps 221 and 222 (approximately at the intersection of longitudinal axis 216 and longitudinal axis 217) so as to provide an opening extending between the two lateral surfaces of outer clamp member 210, wherein recess 218 allows for a longitudinal overextension of a material object placed on straight edge surface 212 if desired. In other words, a material object placed on straight edge surface 212 may be moved passed surface step 222 into recess 218 along longitudinal axis 217. This may facilitate alignment of material objects (e.g., model pieces) placed into clamping device 200. Recess 218 further allows the modeler to apply adhesives without parts of clamping device 200 obstructing access to the material objects, and in particular to the area where the material objects come into contact with each other. Recess 218 (in conjunction with recess 240) eliminates any areas where the clamping device itself or a part of it blocks the view of or access to material objects 250 and 251, thereby allowing for the continuous application of adhesive to the material objects (i.e., the junction of material objects 250 and 251) clamped in clamping device 200 (see also FIG. 6).

Referring back to FIG. 1 and the prior clamping device 100 depicted therein, straight edge surfaces 123 and 124 are both terminated by recess 127 located at the inner base of L-shaped outer clamp member 120 (i.e., between surface steps 128 and 129), thereby allowing material objects to be placed on either straight edge surface 123 or 124 to overextend past surface steps 128 and/or 129 and past the respective virtual extensions of straight edge surfaces 123 and/or 124 into recess 127. In contrast, and with particular reference to FIGS. 4 and 5, recess 218 of improved clamping device 200 only allows overextending a material object (not shown) past surface step 222 and into recess 218 along longitudinal axis 217, if the object is placed on straight edge surface 212. A material object placed on straight edge surface 211 may be moved past surface step 221 however, straight edge surface 212 provides a positive stop, preventing a (rigid) material object to move beyond straight edge surface 212 along longitudinal axis 216 and into recess 218.

Figure 7A:
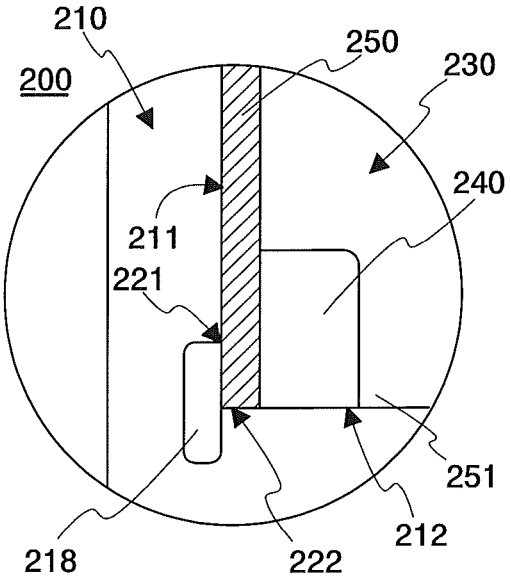
FIG. 7*a* is a detailed side view of one embodiment of the present disclosure of an improved clamping device illustrating the positive stop included in the device.
Figure 7B:
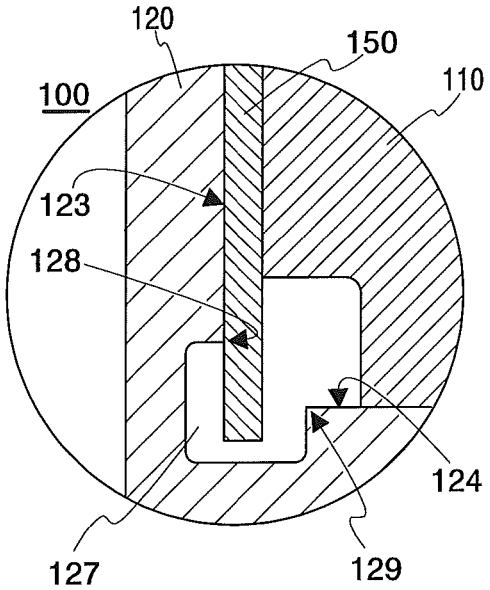
Fig. 7b (Prior Art)
FIG. 7*b* is a detailed side view of the prior clamping device illustrating in the effect of the missing positive stop.

In addition, recess 218 of the embodiment shown in FIGS. 4 and 5, and in particular FIG. 7*a*, extends between surface step 221 and surface step 222, whereby recess 218 is shaped so that straight edge surface 212 extends along its longitudinal axis 217 to surface step 222 and whereby straight edge surface 212 further provides a positive stop for material object 250 placed along perpendicular straight edge surface 211. In other words, recess 218 is shaped so that (rigid) material object 250 placed parallel along perpendicular straight edge surface 211 cannot be moved past surface step 222 and into recess 218. In contrast, and as described above, the prior clamping device 100, as shown in FIG. 1 and FIG. 7*b*, includes recess 127 which terminates both perpendicular straight edge surfaces 123 and 124 at surface steps 128 and 129, respectively, so that material object 150 placed along straight edge surface 123 may be moved past surface step 128 into recess 127.

Figure 8A:
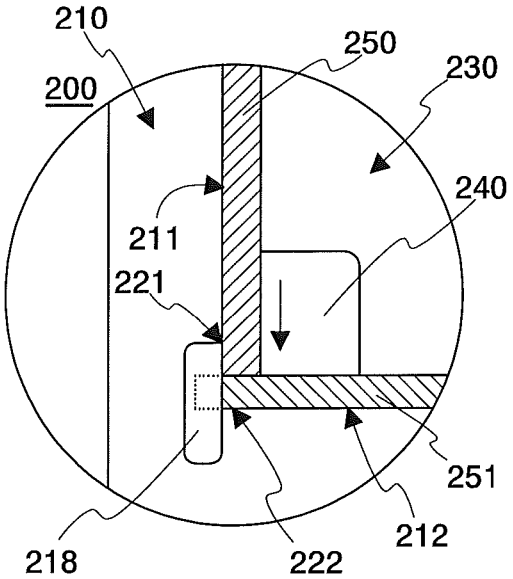
FIG. 8*a* is a detailed side view of one embodiment of the present disclosure of an improved clamping device illustrating the improved alignment of material objects using the device.
Figure 8B:
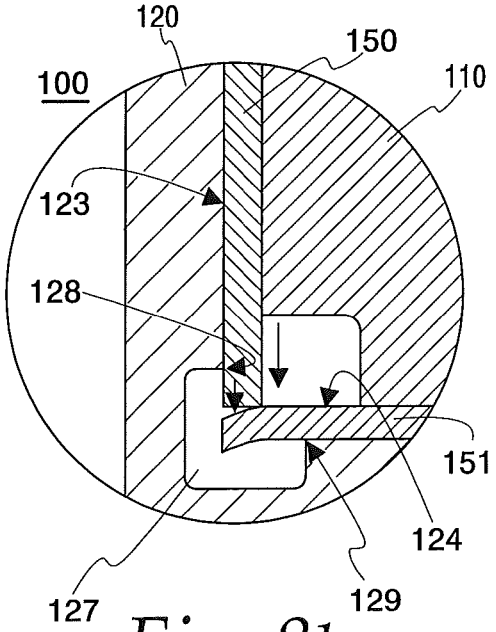
Fig. 8b (Prior Art)
FIG. 8*b* is a detailed side view of the prior clamping device illustrating possible bending of material objects during assembly using the prior clamping device.

Furthermore, and with particular reference to FIG. 8*b*, prior clamping device 100 does not prevent unintentional bending (flexing) of material object 151 placed on straight edge surface 124 and moved passed surface step 129 into recess 127. In particular, material object 151 aligned with material object 150 for assembly as shown in FIG. 8*b*, may experience a downward force that may cause a portion of material object 151 to bend.

The embodiment of clamping device 200, as best shown in FIG. 8*a*, is configured to prevent such unintentional bending. In particular, surface step 222 of straight edge surface 212 is positioned so that material object 251 placed on straight edge surface 212 cannot bend downward due to any force applied by material object 250 placed along perpendicular straight edge surface 211.

Another embodiment of clamping device 200 comprises visual and/or tactile markings 219, 220, 241 and 242, indicating to a user of the device whether outer clamp member 210 and inner clamp member 230 are correctly aligned with regard to the particular location of the north and south poles of the respective magnets 213, 214, 235 and 236 when attempting to magnetically couple outer 210 and inner clamp member 230 to each other so as to ensure that the unlike poles are properly aligned resulting in the desired magnetic attraction to create the coupling of the clamp members. FIGS. 3-6 show markings 219, 220, 241 and 242 in the form of visual markings (here, triangle). However, this disclosure is not limited to a particular kind of visual marking, i.e., a particular shape, number, color or even location of the markings or any particular way of affixing the visual markings to the clamping device, as long as the markings facilitates the desired correct alignment of the clamp members 210 and 230. It is further envisioned the markings 219, 220, 241 and 242 may be integrally formed (e.g., recessed or protruding, etc.) into outer 210 and/or inner clamp member 230.

The embodiment of the present disclosure relates to an improved clamping device for magnetically clamping nonmagnetic material objects. The above description is presented to enable one of ordinary skill in the art to make and use the disclosure and is provided in the context of a patent application and its requirements. While this disclosure contains descriptions with reference to certain illustrative aspects, it will be understood that these descriptions shall not be construed in a limiting sense. Rather, various changes and modifications can be made to the illustrative embodiments without departing from the true spirit, central characteristics and scope of the disclosure, including those combinations of features that are individually disclosed or claimed herein. Furthermore, it will be appreciated that any such changes and modifications will be recognized by those skilled in the art as an equivalent to one or more elements of the following claims, and shall be covered by such claims to the fullest extent permitted by law.

What is claimed is:

1. A clamping device for magnetically clamping nonmagnetic material objects, the device comprising:

a first clamp member having at least a first straight edge surface, the first clamp member having at least a first magnet disposed therein;

a second clamp member having at least a second straight edge surface, the second clamp member having at least a second magnet disposed therein;

wherein the first straight edge surface of the first clamp member and the second straight edge surface of the second clamp member are adapted to magnetically and removably couple the first and second clamp members, wherein the magnetic coupling is capable of clamping a non-magnetic material object in between the first and second straight edge surfaces; and a support member coupled to the first clamp member for securely positioning the clamping device on an underlying substantially level surface.

2. The clamping device of claim 1, wherein the first magnet is located proximate to the first straight edge surface and the second magnet is located proximate to the second straight edge surface.

3. The clamping device of claim 1, wherein at least one of the clamp members is at least partially transparent proximate to the respective straight edge surface.

4. The clamping device of claim 1, wherein at least one of the clamp members comprises at least one opening.

5. The clamping device of claim 1, wherein the first clamp member comprises a recess in the straight edge surface.

6. The clamping device of claim 1, wherein the support member is removably coupled to the first clamp member.

7. The clamping device of claim 1, wherein the first and second clamp members each comprise one or more markings indicating the correct alignment of the first and second clamp members with respect to each other so as to ensure that the poles of the respective magnets disposed in the clamp members are aligned in a way that the attract each other, resulting in a magnetic coupling of the clamping members.

8. The clamping device of claim 7, wherein the one or more markings are visual two-dimensional markings.

9. The clamping device of claim 7, wherein the one or more markings are tactile three-dimensional markings.

10. A clamping device for magnetically clamping non-magnetic material objects, the device comprising:

a first clamp member having at least a first straight edge surface, the first clamp member having at least a first magnet disposed therein;

a second clamp member having at least a second straight edge surface, the second clamp member having at least a second magnet disposed therein;

wherein the first straight edge surface of the first clamp member and the second straight edge surface of the second clamp member are adapted to magnetically and removably couple the first and second clamp members, wherein the magnetic coupling is capable of clamping a non-magnetic material object in between the first and second straight edge surfaces;

wherein at least one of the clamp members is at least partially transparent proximate to the respective straight edge surface; and a support member for securely positioning the clamping device on an underlying substantially level surface.

11. The clamping device of claim 10, wherein the first magnet is located proximate to the first straight edge surface and the second magnet is located proximate to the second straight edge surface.

12. The clamping device of claim 10, wherein at least one of the clamp members comprises at least one opening.

13. The clamping device of claim 10, wherein the first clamp member comprises a recess in the straight edge surface.

14. The clamping device of claim 10, wherein the support member is removably coupled to the clamping device.

15. The clamping device of claim 10, wherein the first and second clamp members each comprise one or more markings indicating the correct alignment of the first and second clamp members with respect to each other so as to ensure that the poles of the respective magnets disposed in the clamp members are aligned in a way that they attract each other, resulting in a magnetic coupling of the clamping members.

16. The clamping device of claim 15, wherein the one or more markings are visual two-dimensional markings.

17. The clamping device of claim 15, wherein the one or more markings are tactile three-dimensional markings.

18. A clamping device for magnetically clamping non-magnetic material objects, the device comprising:

a first clamp member having at least a first straight edge surface, the first clamp member having at least a first magnet disposed therein;

a second clamp member having at least a second straight edge surface, the second clamp member having at least a second magnet disposed therein;

wherein the first straight edge surface of the first clamp member and the second straight edge surface of the second clamp member are adapted to magnetically and removably couple the first and second clamp members, wherein the magnetic coupling is capable of clamping a non-magnetic material object in between the first and second straight edge surfaces; and wherein the first and second clamp members each comprise one or more markings indicating the correct alignment of the first and second clamp members with respect to each other so as to ensure that the poles of the respective magnets disposed in the clamp members are aligned in a way that they attract each other, resulting in a magnetic coupling of the clamping members.

19. The clamping device of claim 18, wherein the one or more markings are visual one-dimensional markings.

20. The clamping device of claim 18, wherein the one or more markings are tactile three-dimensional markings.

* * * * *